US008985481B2

(12) United States Patent
Bartlett

(10) Patent No.: US 8,985,481 B2
(45) Date of Patent: Mar. 24, 2015

(54) ATTACHABLE SPRINKLER DEFLECTOR

(76) Inventor: Simon Bartlett, Bonita Springs, FL (US)

( * ) Notice: Subject to any disclaimer, the term of this patent is extended or adjusted under 35 U.S.C. 154(b) by 236 days.

(21) Appl. No.: 13/549,950

(22) Filed: Jul. 16, 2012

(65) Prior Publication Data

US 2013/0020409 A1 Jan. 24, 2013

Related U.S. Application Data

(60) Provisional application No. 61/509,867, filed on Jul. 20, 2011.

(51) Int. Cl.
*B05B 15/00* (2006.01)
*B05B 1/26* (2006.01)
*B05B 15/04* (2006.01)

(52) U.S. Cl.
CPC ..... *B05B 15/001* (2013.01); *B05B 15/04* (2013.01); *B05B 1/267* (2013.01)
USPC ..... 239/288

(58) Field of Classification Search
CPC ..... B05B 1/26; B05B 1/262; B05B 1/267; B05B 1/28; B05B 3/08; B05B 15/001; B05B 15/04; B05B 15/0443
USPC ..... 239/200–206, 288–288.5, 505, 239/507–516, 521, DIG. 1; 248/74.2, 75
See application file for complete search history.

(56) References Cited

U.S. PATENT DOCUMENTS

| | | | | |
|---|---|---|---|---|
| 719,252 | A * | 1/1903 | O'Kelly | 239/426 |
| 846,491 | A * | 3/1907 | Lutes | 239/275 |
| 2,123,425 | A * | 7/1938 | Kelley | 239/510 |
| 2,973,148 | A * | 2/1961 | Franz | 239/230 |
| 3,703,993 | A | 11/1972 | Schreiner | |
| 4,461,423 | A | 7/1984 | Davis | |
| 4,484,709 | A | 11/1984 | Hosie | |
| 5,267,689 | A | 12/1993 | Forer | |
| 6,336,599 | B1 * | 1/2002 | Herr et al. | 239/522 |
| 6,575,380 | B2 * | 6/2003 | Corbett | 239/1 |
| 6,962,299 | B2 | 11/2005 | Hakala | |
| 7,066,404 | B1 * | 6/2006 | Kollar | 239/288 |

* cited by examiner

*Primary Examiner* — Darren W Gorman
(74) *Attorney, Agent, or Firm* — Daniel Boudwin; Global Intellectual Property Agency LLC

(57) ABSTRACT

Disclosed is a rapidly deployable guard for rotary, stationary and pop-up type sprinklers, wherein a guard having an upstanding deflector surface connects around the sprinkler riser using a pair of deformable arms and a connector therebetween. The deflector blocks spray from the sprinkler in a given direction, while the attachment arms provide a readily deployable connector around the riser of an existing sprinkler. The connector preferably comprises a removable zip tie fastener that extends through apertures in the attachment arms, or is alternately a zip tie fastener attached to the distal ends thereof. In an alternate embodiment, the deflector shield includes an extension member having an overhang portion for blocking spray from multiple orientations around the circumference of the sprinkler spray pattern.

6 Claims, 3 Drawing Sheets

ATTACHABLE SPRINKLER DEFLECTOR

CROSS REFERENCE TO RELATED APPLICATION

This application claims the benefit of U.S. Provisional Application No. 61/509,867 filed on Jul. 20, 2011, entitled "Sprinkler Head Attachment." The patent application identified above is incorporated here by reference in its entirety to provide continuity of disclosure.

BACKGROUND OF THE INVENTION

1. Field of the Invention

The present invention relates to sprinkler attachments and sprinkler guards for blocking spray therefrom. More specifically, the present invention pertains to a rapidly deployable and inexpensive sprinkler guard that blocks spray from a sprinkler in a given orientation, wherein the sprinkler may be of rotary or stationary type.

Sprinklers and sprinkler systems are commonly deployed devices that are utilized to distribute water over a defined area without requiring the user to manually direct the spray of water or hold a water hose. These devices vary between the simple hose attachment article to the more sophisticated systems involving deployable sprinkler heads joined by a series of buried water supply lines. These devices are very convenient, and are an indispensible part of agriculture, general lawn care and professional turf management. However, it is well known that these systems often create an uneven or overreaching spray pattern when in operation, particularly in bordered areas or those that are often deployed in residential environments. Sprinklers are deployed for the purposes of spreading water in an encompassing manner, where all areas of a lawn or farm are provided water for growth; however, it is not desirable to spray onto surfaces not requiring watering, for instance onto adjacent sidewalls, against houses, onto cars or further onto parts of trees or lawns that do not require constant watering or exposure to moisture.

Sprinkler guards are devices that have been deployed for addressing these issues related to overspray of sprinkler spray patters. These devices establish a defined spray pattern emanating from a sprinkler head by modifying its outgoing stream of water. These generally operate by blocking a portion of the spray pattern or shrouding an area from exposure to the outgoing water, whereby a rotating sprinkler is blocked around a given portion of its circumference or the outgoing spray pattern from a stationary nozzle is adjusted to avoid overspray in certain areas. Most sprinkler guards are sophisticated structures for defining the spray pattern for a rotary sprinkler head, and generally require a specific means of attachment to a sprinkler riser. The present invention is provided as a sprinkler guard having a universal attachment means and a simple construction that allows homeowners or sprinkler maintenance personnel to quickly and easily adjust the spray pattern of an existing sprinkler without tools or specific connections.

Specifically, the present invention provides an upstanding spray deflector that attaches to an attachment means defined by a pair of deformable arms, which are adapted to conform to the outer surface of a sprinkler riser and attach using a removable zip tie. The deflector is placed in an orientation that blocks outgoing spray from those areas not requiring watering, while the entire assembly is easily attachable and removable from an existing system. The structure, attachment and ease of use provide a readily deployable and inexpensive alternative to existing structures associated with controlling sprinkler overspray.

2. Description of the Prior Art

Devices have been disclosed in the prior art that relate to sprinklers and sprinkler guard devices. These include devices that have been patented and published in patent application publications, and generally relate to guards having specific attachment structures or those having individually manipulated members for defining a radial spray pattern for a rotary sprinkler. The forgoing is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 4,484,709 to Hosie discloses a sprinkler deflector having a flab base and upwardly and outwardly extending V-shaped deflector arms. The deflector is adapted to be mounted between a sprinkler head and a sprinkler riser or hose via an aperture in the base. The V-shaped deflector arms are pointed inwards to divert water spray from the sprinkler head away from a defined area in four orthogonal directions, wherein the un-watered areas are adapted to coincide with the tree trunks in an orchard. The angle of the deflector arms is adjustable to change the width of the unwatered areas. The goal of the Hosie device is to create un-watered areas about the perimeter of the otherwise circular sprinkler pattern, wherein the trunks of orchard trees are not overly saturated and prone to mold development. The structure and intent of the Hosie device diverges from the elements of the present invention, which provides a shield having a quick sprinkler riser connection means.

U.S. Pat. No. 4,461,423 to Davis is another such device that discloses a sprinkler shield having a semi-circular deflector attached to a sprinkler quick connector. The quick connect comprises a support rod having a lower hook adapted to form around a sprinkler standpipe, along with a brace that projects from the support rod midway therealong. The hook and brace secure the rod and deflector to the sprinkler standpipe for positioning the deflector in front of the sprinkler spray field. The Davis device, while providing a sprinkler deflector, provides a quick connect and disconnect hook and rod assembly that diverges from the present invention. The present invention provides a more flexible mating area, wherein a deformable sleeve wraps around a sprinkler standpipe or riser and is secured thereto via a zip fastener or similar strap fastener. The diameter of the sprinkler riser can vary without requiring different sized attachment means, while the Davis disclosure is limited by the diameter of the lower hook for establishing a strong connect therewith.

Further, U.S. Pat. No. 3,703,993 to Schreiner discloses a sprinkler deflector for creating a specific watering pattern, comprising a shield that can be made to conform to the shape and size of a lawn portion, wherein the lawn includes borders beyond which require no watering. A conical sheet-metal deflector and a deflector control means define an outgoing pattern of spray after connection with a sprinkler head. The water deflector preferably includes a set of radially positioned deflector fingers that control the shape of the watering pattern by the finger positioning arrangement around the sprinkler head. The Schreiner device, while providing a sprinkler deflector, discloses a shapeable deflector that creates a unique boundary of the outgoing water stream based on its deflector finger positioning. The device is not adapted to be quickly and inexpensively applied to a sprinkler riser, as is desired in the present invention. The Schreiner device is one of greater complexity and diverging purpose.

Finally, U.S. Pat. No. 5,267,689 to Forer discloses a rotary sprinkler deflector cap mounted over a sprinkler head, comprising a plurality of individually adjustable, wedge-shaped deflector plates mounted to the underside of the deflector cap. The deflector plates are individually adjustable in a vertical orientation using adjustment screw mechanisms associated with each plate. A smooth annular sheet connects to each deflector plate to provide a smooth transition between each plate as water from the rotating sprinkler rotates around and water is deflected in different orientations from one plate to another. The Forer device provides an overhanging sprinkler guard that includes a plurality of individually adjustable members that are utilized to create a unique spray pattern emanating from the sprinkler location, wherein some areas are water while others remain un-watered. The structure of the device, while unique, does not disclose a readily attachable shield that is of simple construction and adaptable for all sprinkler types having an upstanding portion for attachment therearound.

The present invention provides a rapidly deployable structure that does not rely on a specific structure for attachment to a sprinkler. The sprinkler riser may take several shapes or forms, while the attachment means is capable of conforming to its outer surface and attaching using a zip tie fastener. It is submitted that the present invention substantially diverges in design elements from the prior art, and consequently it is clear that there is a need in the art for an improvement to existing sprinkler guard devices. In this regard the instant invention substantially fulfills these needs.

SUMMARY OF THE INVENTION

In view of the foregoing disadvantages inherent in the known types of sprinkler guard devices now present in the prior art, the present invention provides a new sprinkler guard that can be utilized for providing convenience for the user when quickly and conveniently connecting a shield or guard to an existing sprinkler or sprinkler system.

It is therefore an object of the present invention to provide a new and improved sprinkler guard device that has all of the advantages of the prior art and none of the disadvantages.

It is another object of the present invention to provide a sprinkler guard device to provide a simple, cost-effective means of deflecting one or more sprinkler head spray orientations using a readily attachable deflector and attachment means.

Another object of the present invention is to provide a sprinkler guard device that includes an upstanding defector that does not deform under pressure load from the outgoing water spray and prevents water from passing therethrough.

Yet another object of the present invention is to provide a sprinkler guard device that includes an embodiment having an extension member and an overhand portion for blocking multiple orientations around the sprinkler perimeter.

A final object of the present invention is to provide a sprinkler guard device that offers a removable or connected securement means and deformable attachment arms for accepting the outer surface of most any existing sprinkler riser.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
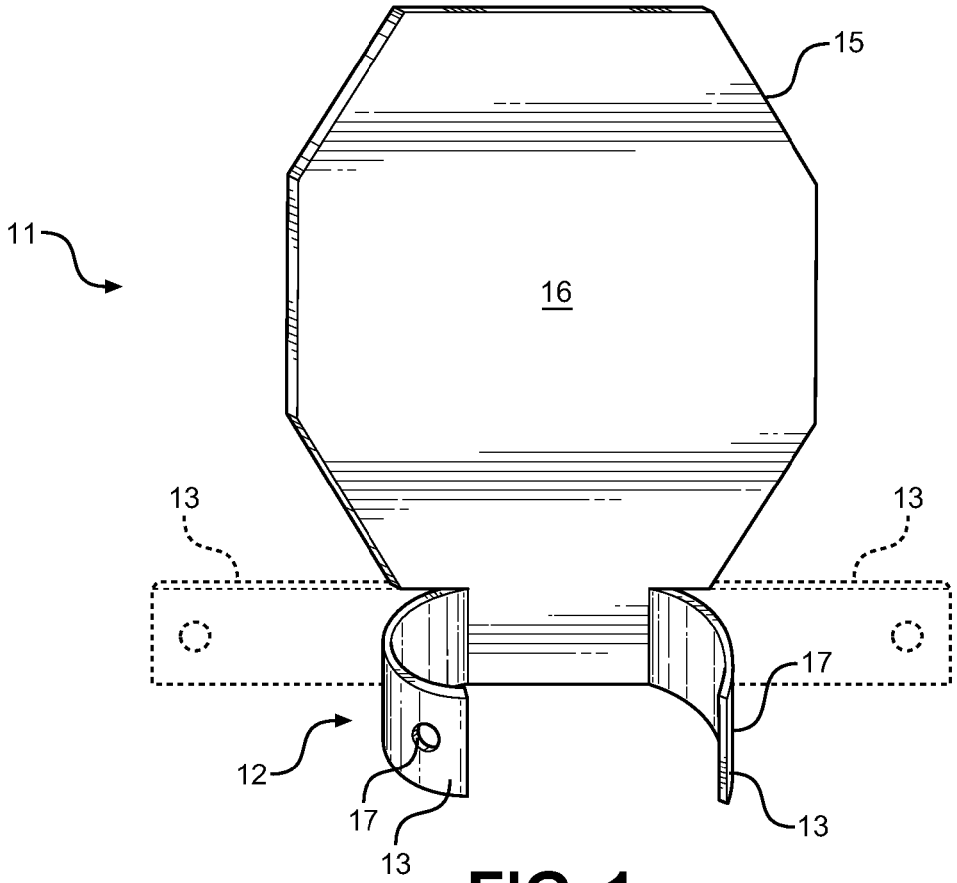
FIG. 1 shows a frontal perspective view of a preferred embodiment of the present invention.

Reference is made herein to the attached drawings. Like reference numerals are used throughout the drawings to depict like or similar elements of the sprinkler guard. For the purposes of presenting a brief and clear description of the present invention, the preferred embodiment will be discussed as used for rapidly and easily deploying on existing sprinklers and providing a means to control spray patterns thereof. The figures are intended for representative purposes only and should not be considered to be limiting in any respect.

Referring now to FIG. 1, there is shown a frontal perspective of the preferred embodiment of the sprinkler guard 11 of the present invention. The guard 11 comprises a spray deflector 15 having a surface 16 adapted to accept directed sprinkler spray and prevent the spray from passing through the deflector 15 and therefore effectively divert it away from an area behind the deflector surface 16. The base of the deflector 15 attaches to a sprinkler attachment means 12, which comprises a first and second deformable attachment arm 13. The arms 13 are adapted to surround the standpipe or riser of a sprinkler, whereafter a zip tie fastener, clasp or similar attachment means is fed through apertures 17 along the arms and tightened around the exterior of the sprinkler riser and the attachment means 12. The deformable nature of the arms allows risers of differing geometry to be accommodated for, while the simple attachment means allows swift attachment and subsequent removal if desired.

The deflector structure is of sufficient stiffness to withstand the pressure exerted on its inward face 16 such that the deflector is not readily deformed when the sprinkler spray is directed at the guard. In this way, the deflector 15 does not yield to the high water pressure and therefore diverts the water along the deflector surface and outwards from its originally intended direction. The shape of the deflector 15 is one of octagonal, square or circular pattern that is of sufficient width to establish the desired stiffness and to create an adequate deflector surface 16 such that spray is not directed over a given area required to remain dry.

Figure 2:
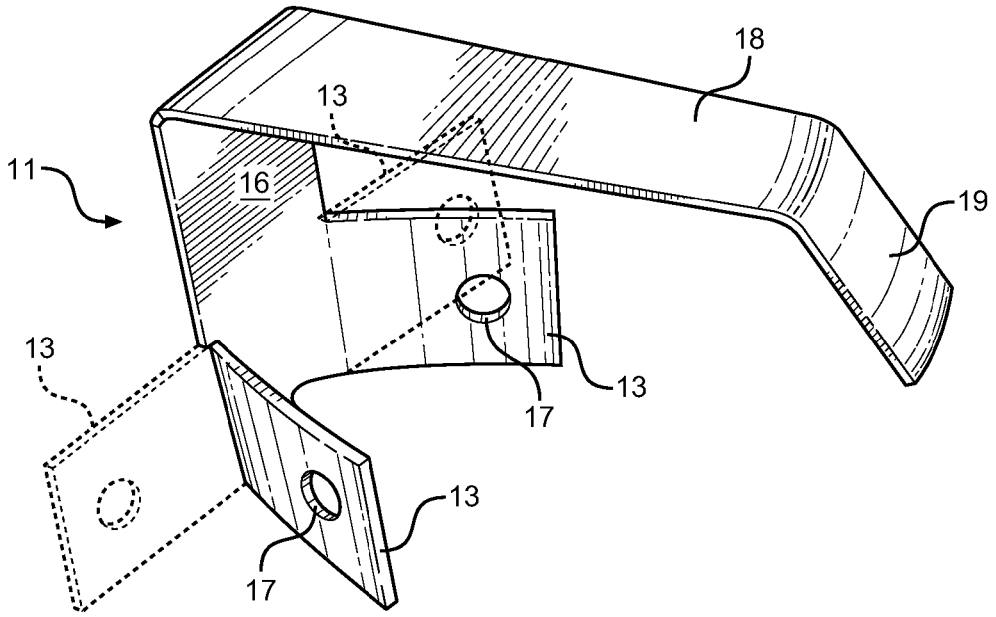
FIG. 2 shows an overhead perspective view of an alternate embodiment of the present invention.

Referring now to FIG. 2, there is shown a perspective view of an alternate embodiment of the present invention, wherein a guard 11 is provided having a rectangular deflector surface 16 that attaches to an extension member 18. The extension member 18 is adapted to be positioned over the sprinkler head while the terminal end of the extension member 18 includes downwardly directed overhang portion 19. The deflector surface 16 and the overhang portion 19 are adapted to create two regions along the periphery of the spray pattern for deflecting outgoing spray. This increases deflector surface area and provides two discrete locations for preventing overspray onto areas not desiring moisture or continual watering. The guard 11 attaches to a similar attachment means as defined in the preferred embodiment, wherein two deformable arms 13 form around an exposed sprinkler riser and are attached thereto using a strap or zip tie. Apertures 17 in the arms 13 provide through-access for the zip tie, wherein the arms 13 are compressed against the sprinkler riser and the zip tie is secured around the exterior of the attachment means and around the exposed periphery of the sprinkler riser.

Figure 3:
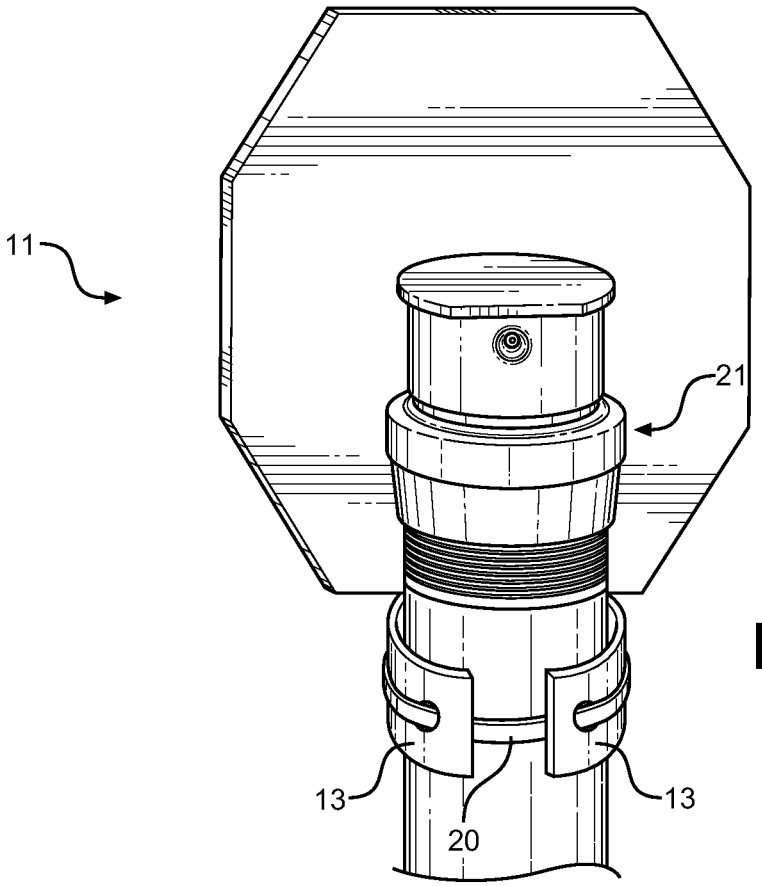
FIG. 3 shows a perspective view of the present invention in a working position.
Figure 4:
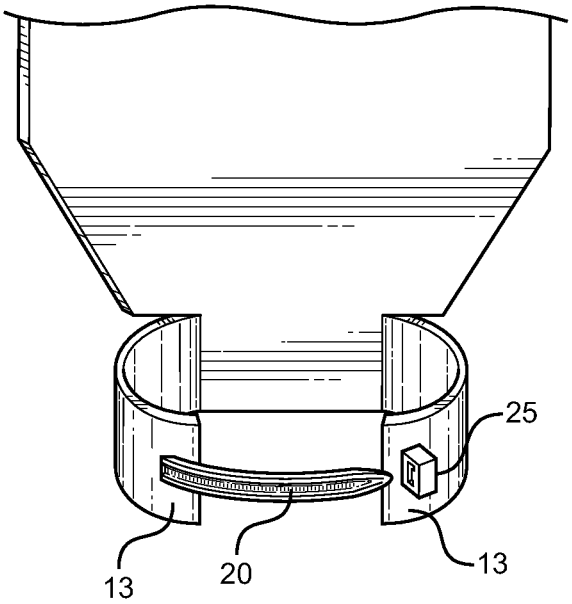
FIG. 4 shows an embodiment of the present invention attachment means, wherein a zip tie fastener is attached to the support arms.
Figure 5:
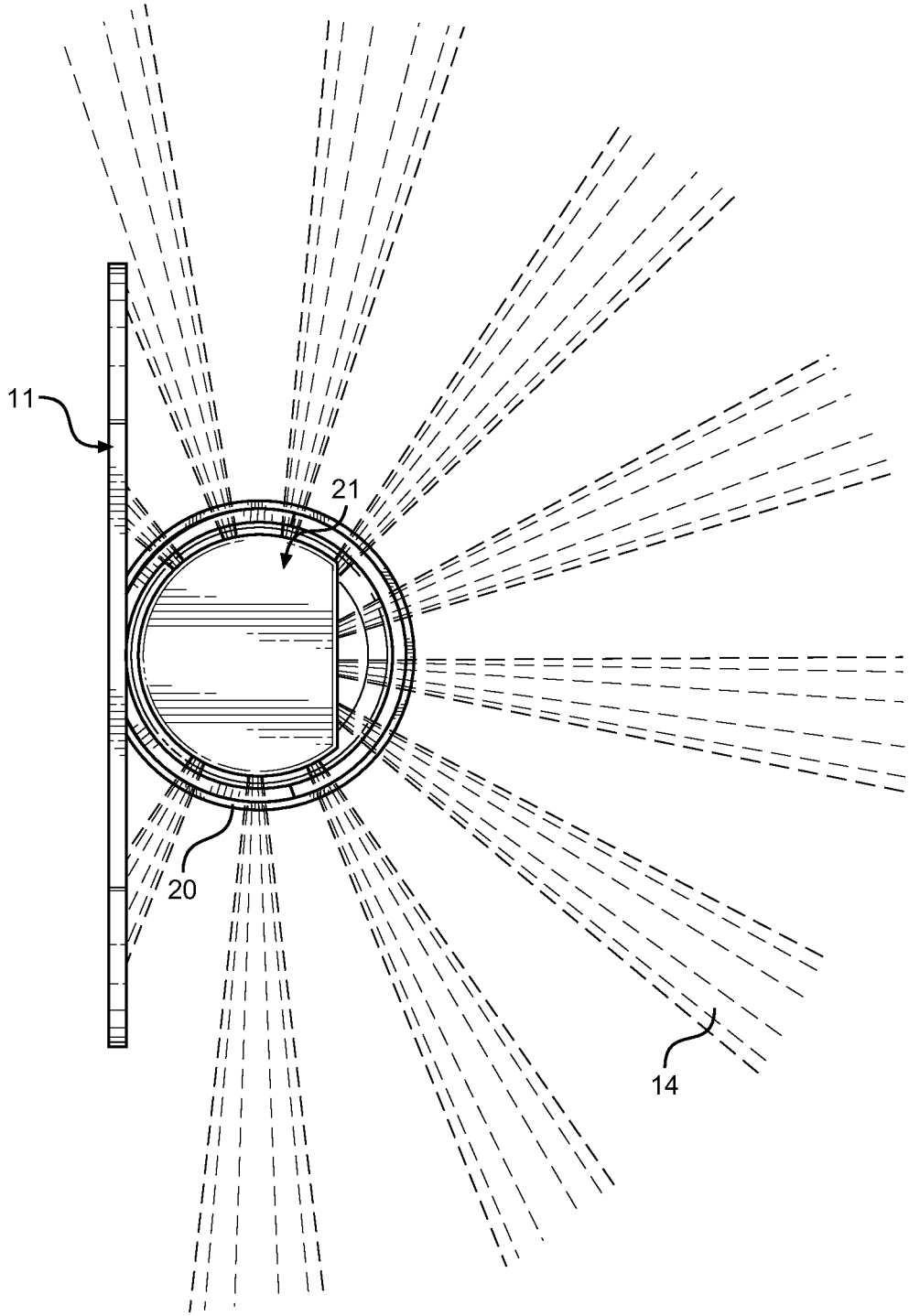
FIG. 5 shows an overhead view showing the present invention in a working state, deflecting outgoing spray to adjust the sprinkler's otherwise uniform spray pattern.

Referring now to FIG. 3 and FIG. 5, there is shown a perspective view and an overhead of the present invention in a working position. The upstanding guard 11 is positionable against a sprinkler riser 21, while the guard attachment arms 13 wrap around the exterior of the riser 21 for securement thereto using a zip tie fastener 20. In FIG. 5, the radial pattern of spray 14 from the sprinkler 21 is visualized, wherein the guard 11 provides a means to deflect the spray 14 from a given orientation to block an area therebehind from moisture. The connection means 20 and arms 13 allow the user to swiftly apply the device to an existing riser 21 for aftermarket application of an existing sprinkler or sprinkler system. Referring now to FIG. 4, there is shown a perspective view of an alternate embodiment of the device attachment means, wherein a clasp 25 and zip tie 20 are each affixed to the arms 13 of the attachment. This eliminates the need for an external attachment means and further for an aperture through each arm. This increases the complexity of the design slightly while reducing the need of the user to carry separate attachment zip ties and feed them through the attachment arms when affixing the device to a sprinkler riser.

Above ground sprinklers are often used as an effective means for dispensing water to various lawn and garden areas for optimal and efficient hydration. These devices, however, may also dispense water onto neighboring exterior walls, outdoor furniture, onto walkways and other various painted objects, causing damage to the property, a nuisance for pedestrians on neighboring walkways, and further to wasted water that is not utilized as intended. Adjusting the settings of sprinkler heads to redirect the flow of water can be challenging, particularly for individuals who are unfamiliar with sprinkler systems. Additionally, users may not be able to finely tune the sprinkler risers to a degree that water is projected over areas requiring watering, while also shielding those areas and surfaces from unnecessary moisture. The present invention designed to facilitate optimal direction control of water that is emitted from above-ground sprinkler systems, while further not providing an overly complicated or sprinkler head-specific design that would otherwise limit its deployment. The device features a unit containing a flat, upstanding deflector surface designed to remain vertically positioned while being subjected to directed water pressure, while the base of the device provides a modular and conforming support system for most any sprinkler riser design. The device acts as a shield, preventing water from being dispensed to undesired areas.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An affixable sprinkler guard for a sprinkler riser, comprising:

an upstanding spray deflector having a substantially planar deflecting surface and a sprinkler connecting means;

said sprinkler connecting means comprising a first and second deformable attachment arm, each arm being deformable from a substantially planar state in plane with said upstanding spray deflector to a conformal state around the periphery of a sprinkler riser;

an elongated fastening means supported by said first and second attachment arm and configured to secure around said sprinkler riser for supporting said upstanding spray deflector in a substantially vertical state;

said upstanding spray deflector having a stiffness sufficient to deflect sprinkler spray from said sprinkler riser without significant deformation and prevent spray therethrough, shielding an area therebehind and deflecting a portion of said outgoing spray;

said substantially planar deflecting surface being entirely located in a plane adjacent to and along said periphery of said sprinkler riser when said arms are secured to said sprinkler riser and said spray deflector is in said substantially vertical state.

2. The device of claim 1, wherein said attachment arms further comprise an aperture for fitting said elongated fastening means therethrough.

3. The device of claim 1, wherein said elongated fastening means attaches to said arms for securing said arms around said sprinkler riser.

4. The device of claim 1, wherein said elongated fastening means is a zip tie fastener.

5. The device of claim 1, wherein said deflector further comprises:

a perpendicular extension member adapted to be positioned above said sprinkler riser, a distal end of said extension member having a downwardly directed overhang portion for deflecting outgoing sprinkler spray.

6. The device of claim 1, wherein said deflector further comprises boundary edges defining a generally octagonal shape.

* * * * *